US005803931A

United States Patent [19]

Glenn et al.

[11] Patent Number: 5,803,931

[45] Date of Patent: Sep. 8, 1998

[54] NON-SOLVENT POLYESTER DYE AUXILIARY

[75] Inventors: Susan C. Glenn; Howard Cole; Brian C. Francois, all of Charlotte, N.C.

[73] Assignee: Henkel Corporation, Plymouth Meeting, Pa.

[21] Appl. No.: 942,310

[22] Filed: Oct. 1, 1997

Related U.S. Application Data

[63] Continuation of Ser. No. 694,347, Aug. 7, 1996, abandoned.

[51] Int. Cl.[6] ..... D06P 1/90; D06P 3/34

[52] U.S. Cl. ..... 8/613; 8/922

[58] Field of Search ..... 8/613, 922

[56] References Cited

FOREIGN PATENT DOCUMENTS

| | | |
|---|---|---|
| 42-23141 | 11/1942 | Japan . |
| 42-23141 | 11/1967 | Japan . |
| 4117340 | 4/1992 | Japan . |

*Primary Examiner*—Margaret Einsmann

*Attorney, Agent, or Firm*—Ernest G. Szoke; Wayne C. Jaeschke; Steven J. Trzaska

[57] ABSTRACT

An aqueous dye composition containing a solvent-free dye carrier selected from the group consisting of mono-styrenated phenols, di-styrenated phenols, tri-styrenated phenols, para-cumenyl phenols, and mixtures thereof.

11 Claims, No Drawings

NON-SOLVENT POLYESTER DYE AUXILIARY

This application is a continuation of application Ser. No. 08/694,347 filed on Aug. 7, 1996 now abandoned.

FIELD OF THE INVENTION

The present invention generally relates to a novel dye carrier. More particularly, the present invention provides a process for dyeing fibers using a solvent-free dye auxiliary which is environmentally acceptable.

BACKGROUND OF THE INVENTION

Dyes are intensely colored substances used for the coloration of various substrates, including paper, leather, fur, hair, foods, drugs, cosmetics, plastics, and textile materials. They are retained in these substrates by physical adsorption, salt or metal-complex formation, solution, mechanical retention, or by the formation of covalent bonds. The methods used for the application of dyes to the substrates differ widely, depending upon the substrate and class of dye. It is by application methods, rather than by chemical constitutions, that dyes are differentiated from pigments. During the application process, dyes lose their crystal structures by dissolution or vaporization. The crystal structures may in some cases be regained during a later stage of the dyeing process. Pigments, on the other hand, retain their crystal or particulate form throughout the entire application procedure. They are usually applied in vehicles, such as paint or lacquer films, although in some cases the substrate itself may act as the vehicle, as in the mass coloration of polymeric materials.

The principle usage or application classes of dyes accounting for 85% of production in the United States are as follows: acid dyes, basic dyes, direct dyes, disperse dyes, fluorescent brighteners, reactive dyes, sulfur dyes, and vat dyes.

Dyeing describes the imprintation of a new and often permanent color, especially by impregnating with a dye, and is generally used in connection with textiles, paper, and leather. Printing may be considered as a special dyeing process by which the dye is applied in locally defined areas in the form of a thickened solution and then fixed.

Generally, dyes are dissolved or dispersed in a liquid medium before being applied to a substrate into which they are fixed by chemical or physical means, or both. Owing to its suitability, its availability, and its economy, water usually is the medium used in dye application; however, nonaqueous solvents have been studied extensively in recent years.

Textile substrates can be classified in three groups: cellulosic, protein, and synthetic polymer fibers. Even and economical distribution of a small amount of dye throughout the substrate and fixation of the dye are the keys to dyeing, i.e., with regard to fastness to washing and to other deteriorating influences. It is the fixation of the dye that the present invention is directed to.

Production of dyeings of acceptable quality requires the use of many auxiliary products and chemicals. These include chemicals that improve fastness properties such as bleaching agents, wefting and penetrating agents, leveling and retarding agents, and lubricating agents. Other agents speed the dyeing process or are used for dispersion, oxidation, reduction, or removal of dyes from poorly dyed textiles.

Dyes of similar or identical chromophobic class are used for widely differing applications and, therefore, are classified according to their usage rather than their chemical constitution. Dyes with identical or similar solubilizing groups generally display similar dyeing behavior even though their main structure may vary substantially. Another important consideration of the use of a given dye for a specific application and fastness properties of commercial dyes is found in the pattern cards issued by their manufacturers. The following classification of colorants for dyeing is used: acid, basic, direct, disperse, insoluble azo, sulfur, vat, fiber-reactive, miscellaneous dyes, and pigments.

The most common types of fibers to be dyed with acid dyes are polyamide, wool, silk, modified acrylic, and polypropylene fibers, as well as blends of the aforementioned fibers with other fibers such as cotton, rayon, polyester, regular acrylic, etc. Approximately 80–85% of all acid dyes sold to the U.S. textile industry are used for dyeing nylon, 10–15% for wool, and the balance for those fibers mentioned above. Acid dyes are organic sulfonic acids; the commercially available forms are usually their sodium salts, which exhibit good water solubility.

Affinity and diffusion are fundamental aspects of the dyeing process. The former describes the force by which the dye is attracted by the fiber, and the latter describes the speed with which it travels within the fiber from areas of higher concentration to areas of lower concentration.

In the application of dyes, there have developed over the years three chief principles of dyeing textiles. The dye liquor is moved as the material is held stationary. The textile material is moved without mechanical movement of the liquor. Examples of which include jig dyeing and continuous dyeing which involves the padding of the fabric. A combination of the two is exemplified by a Klauder-Weldon skein-dye machine in which the dye liquor is pumped as the skeins are mechanically turned. Another example is a jet or spray dyeing machine in which both the goods and the liquor are constantly moving.

A substantially non-mechanical dyeing process is typically referred to as exhaustion. This process involves the preparation of a dye bath containing an aqueous solution, usually water, and the dye. The textile to be dyed is then inserted into the dye bath. The temperature of the dye bath is then raised to a predetermined optimal level, with the pH of the bath being similarly maintained, and the textile material is then soaked in the bath. During this soaking process, the dye contained in the bath is absorbed into the fibers of the textile material in accordance with the principles of affinity and diffusion as described above. Once all of the dye has been absorbed, the bath is referred to as being exhausted, with only the aqueous solution being left.

The selection of proper dyeing equipment depends on the nature and volume of the material to be dyed. Raw stock and yarns are dyed by exhaust methods, whereas fabrics are dyed both by exhaust or continuous methods. The choice of method for fabrics depends largely on the volume to by dyed. Continuous dyeing is usually considered if the volume of fabric for a particular shade is about 10,000 yards or more.

In the dyeing of fabrics, the beck is one of the oldest dyeing machines known. It consists of a tub containing the dye liquor, and an elliptical winch or reel which is located horizontally above the dye bath. Ten or more pieces of fabric are dyed simultaneously. Each piece is drawn over the winch, and its two ends are sewn together to form an endless rope. The ropes are kept in the dyeing machine side by side, separated from each other by rods to prevent them from tangling. During the dyeing process the reel rotates, pulling the ropes out of the dye bath and dropping them back into the dye bathe at the opposite side. In this way almost all the fabric is kept inside the dye bath.

Becks are used for dyeing knits and other light-weight fabrics that can be easily folded into a rope form without causing damage. Fabrics made of filament yarns that tend to break should not be dyed in a beck since the broken filaments will dye deeper. Very light fabrics should also be avoided as they may tend to float on the dye bath tangle.

Jet dyeing machines are similar to Becks in that the fabric is circulated through the dye bath in rope form. However, in a jet the transportation of the fabric occurs by circulating the dye liquor through a venturi jet, instead of the mechanical pull of the reel in a beck. The fabric is pulled out of the main dyeing chamber by means of a high speed flow of dye liquor that passes through the venturi opening.

Modern jet dyeing machines are generally categorized as 'round kier' or 'cigar kier' configurations. Most fabrics can be dyed satisfactorily in conventional round kier dyeing machines such as the Gaston 824 jet dyeing machine. These types of machines operate at low liquor ratio and yield very good results on most fabrics. However, certain fabrics have more of a tendency to develop crush or pile marks due to their constructions.

Padders are used to impregnate fabrics with liquors containing dyes, dyeing assistants or other chemicals. Padding is usually followed continuously by other treatments, from drying to a series of successive treatments. The simplest padder consists of two parts: the trough containing the dye liquor, and two squeezing rollers arranged above the dye liquor. In the padding process, the fabric in its open width form, enters the trough through tension rails, passes through the dye liquor, and is then squeezed between two heavy rubber rollers with the proper hardness, under pressure. Excess dye liquor runs back into the trough.

Impregnation is typically followed by drying during which dye migration becomes a major concern. Evaporating water tends to carry with it dye particles from wet spots to dry spots on the fabric, and from inside or back to face of fabric, and may lead to unlevel and/or shading problems. To prevent migration, drying is done gradually, and/or a chemical migration inhibiting agent may be used to treat the dyed substrate.

Polyester fibers are typically dyed in a heated dye bath containing dye pigments, an acid, water and a dye carrier. The dye carrier enables the dye pigments to be carried into the polyester fiber. Examples of known dye carriers used in the industry include orthodichloro benzene, 1,1,1-trichloro benzene, methyl naphthalene and butyl benzoate. These dye carriers, while effective in transporting the dye pigments into the polyester fibers, are considered by today's standards as being environmentally unacceptable.

It is thus a primary object of this invention to provide a novel dye carrier which is both effective at transporting dye pigments into polyester fibers and environmentally friendly.

SUMMARY OF THE INVENTION

The present invention is directed to a dye composition containing a novel non-solvent dye carrier selected from the group consisting of mono-styrenated phenols having general formula I:

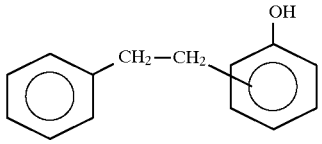

di-styrenated phenols having general formula II:

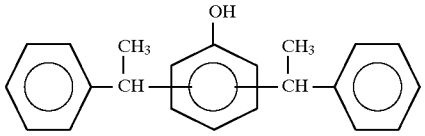

(II), tri-styrenated phenols having general formula III:

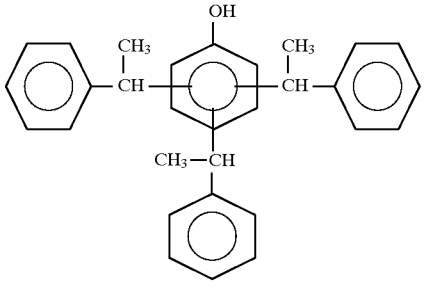

(III), para-cumenyl phenols having general formula IV:

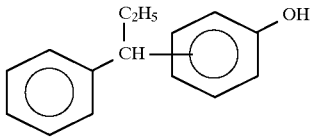

(IV), and mixtures thereof.

The present invention is also directed to a process for dyeing polymeric fibers involving contacting the polymeric fibers with a dye composition containing at least one of the above-disclosed non-solvent dye carriers.

The present invention is also directed to a dye composition containing:

(a) a dye pigment;

(b) an acid;

(c) an emulsifier;

(d) a non-solvent dye carrier selected from the group consisting of a mono-styrenated phenol of formula I, a di-styrenated phenol of formula II, a tri-styrenated phenol of formula III, a para-cumenyl phenol of formula IV, and mixtures thereof; and (e) water.

DESCRIPTION OF THE INVENTION

Other than in the operating examples, or where otherwise indicated, all numbers expressing quantities of ingredients or reaction conditions used herein are to be understood as modified in all instances by the term "about".

The present invention provides a novel non-solvent dye carrier contained in dye compositions used for dyeing polymeric substrates, particularly polyester fibers. The term "polyester fiber" is a generic name for a manufactured fiber, either as staple or continuous filament, in which the fiberforming substance is any long chain synthetic polymer composed of at least 85% by weight of an ester of a dihydric alcohol and terephthalic acid.

Polymeric fibers, such as polyester, are typically dyed in a an aqueous heated dye bath containing a dye composition. Due to the chemical structure of these types of polymeric fibers, dye pigments must first be dissolved into a dye carrier, which in turn transports the dye pigments into the polyester fiber, thereby causing it to become colored. In order for the dye carrier to perform effectively, it must be able to solubilize dye pigments into solution. As the temperature of dye bath increases, the polyester fibers swell so that dye pigments can enter into the fiber and eventually become trapped therein.

According to one aspect of the present invention, there is thus provided a solvent-free, environmentally acceptable, dye carrier for use in combination with a dye composition to dye polymeric substrates, particularly polyester fibers. This novel non-solvent dye carrier is selected from the group consisting of a mono-styrenated phenol having general formula I:

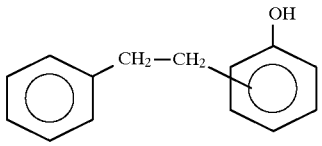

(I), a di-styrenated phenol having general formula II:

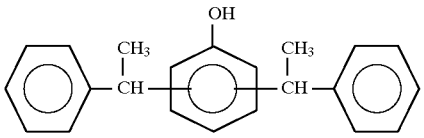

(II), a tri-styrenated phenol having general formula III:

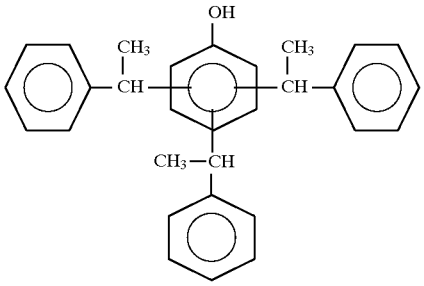

(III), a para-cumenyl styrenated phenol having general formula IV:

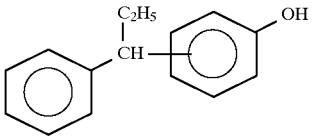

(IV), and mixtures thereof.

Due to the polymeric nature of the non-solvent dye carriers, they are deemed to be non-toxic and, hence, more environmentally friendly than known solvent-based dye carriers. The non-solvent dye carriers of the present invention are typically used in a dye composition/bath in an amount ranging from about 0.5 to about 5.0%, based on the weight of the polymeric fiber being dyed.

According to another aspect of the present invention, there is also provided a process for dyeing polymeric fibers, particularly polyester fibers. The process involves contacting the fibers with an aqueous dye composition containing at least one dye pigment, an acid, an emulsifier, and at least one of the non-solvent dye carriers of the present invention. The dyeing process is typically performed using the exhaust method whereby the temperature of the dye bath is maintained in a range of from about 95° to about 105° C., for a period of about 1.5 to 2 hours. As the temperature of the dye bath rises, a number of phenomena are observed. First, the dye pigment becomes dissolved in the dye carrier allowing it to be taken-up by the polyester fiber. Second, the heat of the dye composition/bath causes the fibers to swell, thereby enabling the dye pigments dissolved in the dye carrier to be taken up by the fibers. Lastly, the dye pigments dissolved in the dye carrier are exhausted out of the dye carrier and into the swelled fibers. After the dye pigments are exhausted into the fibers, the temperature of the dye composition/bath is allowed to cool to room temperature. Upon cooling, the swelled fibers in the dye composition/bath return back to their normal diameter, thereby trapping the dye pigments therein.

According to yet another embodiment of the present invention, there is also provided a novel dye composition containing at least one of the above-disclosed non-solvent dye carriers, in combination with at least one dye pigment, an acid, such as acetic acid, an emulsifier, and water. In one embodiment thereof, the non-solvent dye carrier is present in the dye composition in an amount ranging from about 0.5 to about 5.0%, and preferably from about 1 to about 2%, based on the weight of polymeric fiber, preferably polyester, to be dyed. The amount of dye pigments contained in the dye composition typically ranges from about 0.1 to about 5.0%, based on the weight of polyester fibers to be dyed. Typically, the dye pigment and dye carrier, respectively, will be present in the dye composition in a ratio by weight of from about 1:5 to about 1:1. It should be noted, however, that the exact proportions of dye carrier and dye pigments to be used will depend on a number variables to be determined by one skilled in the dyeing art, some of which include, the type of dye pigments employed and the color intensity desired.

The types of acids which may be used in the composition of the invention are well known in the dyeing industry, one example of which is acetic acid. The function of these acids is to modify the pH of the dye bath, which will typically range from about 3 to about 6, and preferably from about 4 to about 5.

It should also be noted that other dye auxiliaries typically used in dyeing polymeric substrates, particularly polyester fibers, may also be employed without departing from the spirit of the invention.

What is claimed is:

1. A composition for dyeing polyester fibers comprising:

(a) a dye;

(b) an acid;

(c) a solvent-free dye carrier selected from the group consisting of mono-styrenated phenols having general formula I:

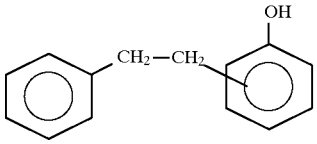

(I), di-styrenated phenols having general formula II:

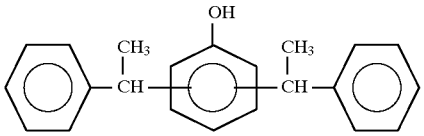

(II), tri-styrenated phenols having general formula III:

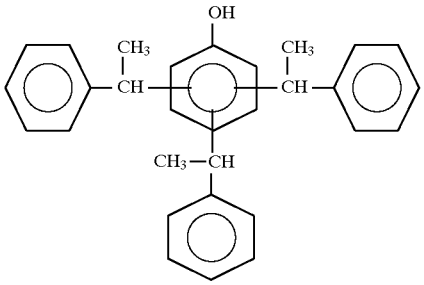

(III), para-cumenyl phenols having general formula IV:

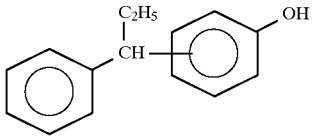

(IV), and mixtures thereof;

(d) an emulsifier; and (e) water.

2. The composition of claim 1 wherein the acid is acetic acid.

3. The composition of claim 1 wherein the dye and dye carrier, respectively, are present in the composition in a ratio by weight of from about 1:5 to about 1:1.

4. The composition of claim 1 wherein the solvent-free dye carrier is a mono-styrenated phenol of formula I.

5. The composition of claim 1 wherein the solvent-free dye carrier is a di-styrenated phenol of formula II.

6. The composition of claim 1 wherein the solvent-free dye carrier is a tri-styrenated phenol of formula III.

7. The composition of claim 1 wherein the solvent-free dye carrier is a para-cumenyl phenol of formula IV.

8. A process for dyeing polyester fibers by the exhaust method at a pH of about 3 to about 6 wherein the exhaust dyebath comprises:

(a) a dye;

(b) an acid;

(c) a solvent-free dye carrier selected from the group consisting of mono-styrenated phenols having general formula I:

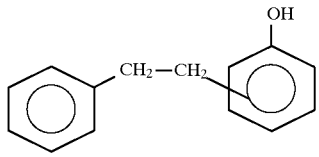

(I), di-styrenated phenols having general formula II:

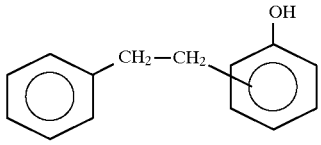

(II), tri-styrenated phenols having general formula III:

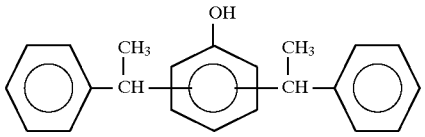

(III), para-cumenyl phenols having general formula IV:

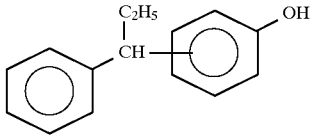

(IV), and mixtures thereof;

(d) an emulsifier; and (e) water.

9. The process of claim 8 wherein the acid is acetic acid.

10. The process of claim 8 wherein the dye pigment and dye carrier, respectively, are present in the dye composition in a ratio by weight of from about 1:5 to about 1:1.

11. The process of claim 8 wherein the contacting step is performed at a temperature ranging from about 95° to about 105° C.

* * * * *